US008491082B2

(12) United States Patent
Chiba

(10) Patent No.: US 8,491,082 B2
(45) Date of Patent: Jul. 23, 2013

(54) RECORDING APPARATUS AND RECORDING METHOD OF RECORDING APPARATUS

(75) Inventor: Takumi Chiba, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 66 days.

(21) Appl. No.: 13/297,109

(22) Filed: Nov. 15, 2011

(65) Prior Publication Data

US 2012/0120139 A1 May 17, 2012

(30) Foreign Application Priority Data

Nov. 16, 2010 (JP) ..... 2010-256262

(51) Int. Cl.
*B41J 29/393* (2006.01)
*B41J 2/195* (2006.01)

(52) U.S. Cl.
USPC ..... 347/19; 347/7

(58) Field of Classification Search
CPC ..... B41J 2/17513; B41J 2/1753
USPC ..... 347/7, 9, 12, 14, 19, 40
See application file for complete search history.

(56) References Cited

U.S. PATENT DOCUMENTS 7,850,263 B2 * 12/2010 Shinada et al. ..... 347/7
8,061,799 B2 * 11/2011 Kimura ..... 347/19

FOREIGN PATENT DOCUMENTS

JP 2000-015837 A 1/2000
JP 2003-001842 A 1/2003

* cited by examiner

*Primary Examiner* — An Do
(74) *Attorney, Agent, or Firm* — Kilpatrick Townsend & Stockton LLP

(57) ABSTRACT

When ink is depleted, slow printing is performed, and the print data of one nozzle row is created. If ink is depleted in a first ink cartridge, the print data is set to the nozzle row D, and ink is ejected from the nozzle row D connected to the second ink cartridge in which ink is not depleted, thereby performing the printing. Meanwhile, if ink is depleted in the second ink cartridge, the print data is set to the nozzle row C, and ink is ejected from the nozzle row D connected to the first ink cartridge in which ink is not depleted, thereby performing the printing.

8 Claims, 8 Drawing Sheets

WHEN SWITCH PLUG = 1

WHEN SWITCH PLUG = 0

WHEN INK IS DEPLETED
IN FIRST INK CARTRIDGE

WHEN INK IS DEPLETED
IN SECOND INK CARTRIDGE

RECORDING APPARATUS AND RECORDING METHOD OF RECORDING APPARATUS

This application claims priority to Japanese Patent Application No. 2010-256262, filed Nov. 16, 2010, the entirety of which is incorporated by reference herein.

BACKGROUND

1. Technical Field

The present invention relates to a recording apparatus that performs recording by the use of a nozzle row to be supplied with liquid from a liquid receptor of a side where liquid remains, when liquid is depleted in at least one of a plurality of liquid receptors receiving the same kind of liquid, and a recording method.

2. Related Art

As this kind of printing apparatus, an ink jet type printer is known which ejects ink supplied from an ink cartridge from nozzles of a recording head, thereby printing a document, an image or the like on a print medium such as paper.

In the related art, a printing apparatus is disclosed which has a configuration in which an ink tank to be used in forming an ink dot is selected depending on respective ink residual quantities of a plurality of ink tanks that accommodates the same color ink (for example, JP-A-2003-1842, JP-A-2000-15837 or the like). For example, according to the printing apparatus described in JP-A-2003-1842, an additional nozzle row and a black ink nozzle row capable of ejecting black ink are separately connected to an additional ink tank and a black ink tank, respectively. The additional nozzle row is shifted to the black ink nozzle row by two dots in a sub scanning direction. For this reason, in the case of a monochrome printing mode, when both of the additional ink tank and the black ink tank are determined to be usable ink tanks, printing is performed at a high speed by the use of both of the additional nozzle row and the black ink nozzle row. In this case, the additional nozzle row and the black ink nozzle row K form the different raster lines by the same main scanning.

Furthermore, when an ink residual quantity of one ink tank is not equal to or greater than a threshold value, if ink remains in any one of the plurality of ink tanks, it is possible to form ink dots by the use of the nozzle row that is supplied with ink from the ink tank of the side where ink remains.

Furthermore, in the printing apparatus described in JP-A-2000-15837, ink is selectively supplied from at least a pair of ink cartridges for supplying the same color ink to an ink jet type recording head via an ink supply valve. In the printing apparatus, when an ink depletion detection unit detects that one of the ink cartridges is depleted, the valve is switched by valve opening and closing control unit, whereby the printing can be continued.

However, in the printing apparatus of JP-A-2003-1842, if ink remains in any one of a plurality of ink tanks, ink dots are formed by the use of the nozzle row supplied with ink from the ink tank of the side where ink remains. In this case, the additional nozzle row and the black ink nozzle row are shifted by two dots in the sub scanning direction, and the dots printed in the first main scanning are different from each other between the additional nozzle row and the black ink nozzle row, and thus, there is a need to create the different print data depending on the use nozzle row.

In this case, upon detecting the ink depletion, the ink tank of the ink depletion is confirmed (a cartridge confirmation process), and the nozzle row connected to another ink tank, where ink remains, is selected in the use nozzle row (a nozzle row selection process). Moreover, the print data depending on the selected use nozzle row is generated (a print data generating process). Furthermore, the reception place of the print data confirms whether or not the print data is correct depending on the use nozzle row (a data confirmation process). Moreover, when it is confirmed that the print data is correct corresponding to the use nozzle row, the print data is set to the driving system of the corresponding nozzle row and an ink droplet is ejected from the use nozzle row of the recording head, thereby performing the printing on the paper.

In this manner, since there is a need to discriminate the nozzle row connected to the ink cartridge of the side in which ink remains and generates the print data depending on the discriminated nozzle row, as mentioned above, there is a need for a plurality of processes such as the cartridge confirmation process, the nozzle selection process, the print data generating processing, and the data confirmation process. For this reason, the process to be performed when the ink in the ink tank becomes depleted is complicated. As a consequence, there is a problem in that the process burden of a CPU due to the complication of the process is increased, and it is difficult to share the processing program between types of model having different nozzle arrangement patterns of the printing apparatus.

SUMMARY

An advantage of some aspects of the invention is to provide a recording apparatus that can perform the recording by the use of a nozzle row connected to a liquid receptor of a side in which liquid remains even when liquid is depleted, and can effectively perform the process required for the recording without a need for a change in recording data depending on the use nozzle row when liquid is depleted, and a recording method in the recording apparatus.

According to an aspect of the invention, there is provided a recording apparatus that includes a recording unit which is supplied with liquid from each of M liquid receptors (M is a natural number equal to or more than two) each receiving the same kind of liquid and can be moved in a main scanning direction, and a transport unit that transports a recording medium in a sub scanning direction, wherein the recording apparatus includes the recording unit in which M nozzle rows having the same position of nozzles in the sub scanning direction are disposed so that the positions thereof are shifted in a main scanning direction; a flow path which supplies liquid from the M liquid receptors to the M nozzle rows; a determination unit that determines whether or not liquid is depleted in one of the M liquid receptors; a data generating unit which generates first recording data capable of recording first single nozzle row data by the use of all of the M nozzle rows when it is determined that liquid is not depleted in any one of the M liquid receptors, and generates second recording data capable of recording second single nozzle row data capable of commonly being used in the M nozzle rows when it is determined that liquid is depleted; and a control unit that sends the first recording data to a driving system of the M nozzle rows to perform the recording of the first single nozzle row data using all of the M nozzle rows, and sends the second recording data to a driving system of the nozzle rows corresponding to the liquid receptor, in which liquid is not depleted, to perform the recording of the second single nozzle row data using the nozzle row when liquid is depleted.

According to the aspect of the invention, when it is determined that the liquid of none of the M liquid receptors is depleted, the first recording data capable of recording first single nozzle row data is created using all of the M nozzle rows by the data generating unit. Moreover, the recording of the single nozzle row data is performed by the use of all of the M nozzle rows by the control unit. Furthermore, when it is determined that the liquid is depleted, the second recording data capable of performing the recording of a second nozzle row data capable of being normally used in the M nozzle rows is generated by the data generating unit. Moreover, the second recording data is sent to the driving system of the nozzle row corresponding to the liquid receptor in which the liquid is not depleted, whereby the recording of the second nozzle row data is performed by the use of the nozzle rows. Thus, even when the liquid of the liquid receptor becomes depleted, the recording can be performed by liquid to be supplied from the liquid receptor of the side in which liquid remains. Furthermore, since there is no need to change the recording data needing to be created depending on the use nozzle row in the recording when liquid is depleted, the required process can effectively be performed.

In the recording apparatus according to an aspect of the invention, the recording unit may be provided with J (J is a natural number equal to or greater than M) second nozzle rows including a common nozzle row provided so that positions of the nozzles are shifted by 1/J of a nozzle pitch ΔP to one common nozzle row of the first nozzle row in a sub scanning direction when the M nozzle rows are a first nozzle row, the flow path may be provided so as to connect the second nozzle rows of each set, in which the J second nozzle rows are divided by M set, to each of the M liquid receptors, the data generating unit may create the first recording data capable of being recorded by the use of all of the nozzles of (J−1) second nozzle rows except for the common nozzle row, and the data generating unit may create the second recording data in which the (J−1) second nozzle rows are not used in the recording.

According to the aspect of the invention, when it is not determined that liquid is depleted, by the data generating unit, the first recording data is created in which the recording can be performed by the use of all of the nozzles of the (J−1) second nozzle row except for the common nozzle row and the recording of the first single nozzle row data can be performed by the use of all of the M first nozzle rows. Thus, when the control unit sends the first recording data to the driving system, the recording of the J row is performed in which the recording of (J−1) row using all of the nozzles of the (J−1) second nozzle row is matched with the recording of the first single nozzle row data using all of the M first nozzle rows. Thus, it is possible to perform the printing at a high recording resolution of a small pixel pitch of 1/J of the nozzle pitch ΔP. Meanwhile, when it is determined that the liquid of the liquid receptor becomes depleted, by the data generating unit, the second recording data is created in which (J−1) second nozzle rows are not used in the recording but the recording of the second nozzle row data capable of being normally used in the M nozzle rows can be performed. Thus, when the control unit sends the second recording data to the driving system, the recording is performed by the use of the second nozzle row connected to the liquid receptor in which liquid is not depleted among the M nozzle rows. Thus, when liquid is not depleted, it is possible to perform the recording at a high resolution of the small pixel pitch of 1/J of the nozzle pitch ΔP, and when liquid is depleted, it is possible to perform the recording at a resolution of the pixel pitch equal to the nozzle pitch ΔP by one main scanning, using the first nozzle row connected to the liquid receptor in which liquid is not depleted.

In the recording apparatus according to an aspect of the invention, when it is not determined that liquid is depleted, it is preferable that the control unit perform the recording of the first single nozzle row data in total by the use of all of the M first nozzle rows by one main scanning of the recording unit.

According to the aspect of the invention, in a case where it is not determined that liquid is depleted, when liquid remains in all of the M liquid receptors, the recording of the first single nozzle row data is performed in total using all of the M first nozzle rows by one main scanning of the recording unit.

In the recording apparatus according to an aspect of the invention, when it is not determined that liquid is depleted, it is preferable that the control unit perform the recording by the use of each of 1/M row of the M first nozzle rows.

According to the aspect of the invention, when it is not determined that liquid is depleted, the recording is performed by the use of each of 1/M row of the M first nozzle rows. For this reason, it is possible to suppress the deviation of an amount of liquid supply from the M liquid receptors to the corresponding nozzle rows to a minimum.

In the recording apparatus according to the aspect of the invention, when it is not determined that liquid is depleted, it is preferable that the control unit switch the use nozzles between the M first nozzle rows for each prescribed interval.

According to the aspect of the invention, when it is not determined that liquid is depleted, the use nozzles in the respective first nozzle rows becoming the first single nozzle row data in total are switched for each prescribed interval between the M first nozzle rows. As a consequence, during recording when liquid is not depleted, all of the nozzles of the M first nozzle row are used in the recording, whereby it is easy to reduce the occurrence frequency of the clogging of the nozzles generated by the thickening or the solidification of liquid such as ink in the nozzles.

In the recording apparatus according to the aspect of the invention, it is preferable that the prescribed interval be an interval of one recording page. According to the aspect of the invention, the use nozzles are switched for each one recording page between the M first nozzle rows. Thus, it is possible to suppress a decline in recording image quality (recording quality) due to a change in the use nozzles during recording of one page.

In the recording apparatus according to the aspect of the invention, when it is determined that liquid is depleted and the recording is performed by the use of the first nozzle row connected to the liquid receptor in which liquid is not depleted among the M first nozzle rows, it is preferable that the control unit controls the transport unit so as to transport the recording medium at a pitch of 1/J of the nozzle pitch ΔP.

According to the aspect of the invention, when performing the recording by the use of the first nozzle rows connected to the liquid receptor in which liquid is not depleted among the M first nozzle rows, the transport unit is controlled by the control unit so as to transport the recording medium at a pitch of 1/J of the nozzle pitch ΔP, whereby the recording of the recording resolution of a pixel pitch of 1/J of the nozzle pitch ΔP is performed. Thus, even when liquid is depleted, it is possible to perform the recording at the same recording resolution as the time when liquid is not depleted.

According to another aspect of the invention, there is provided a recording method in a recording apparatus that includes a recording unit which is supplied with liquid from each of M (M is a natural number equal to or greater than two) liquid receptors each receiving the same kind of liquid and can be moved in a main scanning direction, and a transport unit that transports a recording medium in a sub scanning direction, wherein the recording apparatus includes the recording unit in which M nozzle rows having the same position of nozzles in the sub scanning direction are disposed so as to be shifted in a main scanning direction; and a flow path which supplies liquid from the M liquid receptors to the M nozzle rows, the method includes determining whether or not liquid is depleted in one of the M liquid receptors; creating first recording data capable of recording first single nozzle row data by the use of all of the M nozzle rows when it is not determined that liquid is depleted in any one of the M liquid receptors and creating second recording data capable of recording second single nozzle row data capable of commonly being used in the M nozzle rows when it is determined that liquid is depleted; and controlling so as to send the first recording data to a driving system of the M nozzle rows to perform the recording of the first single nozzle row data by the use of all of the M nozzle rows when it is not determined that liquid is depleted in any one of the M liquid receptors, and controlling so as to send the second recording data to a driving system of the nozzle rows corresponding to the liquid receptor, in which liquid is not depleted, to perform the recording of the second single nozzle row data by the use of the nozzle row, when it is determined that liquid is depleted.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment, in which the invention is embodied in an ink jet type printer, will be described FIGS. 1 to 11.

Figure 1:
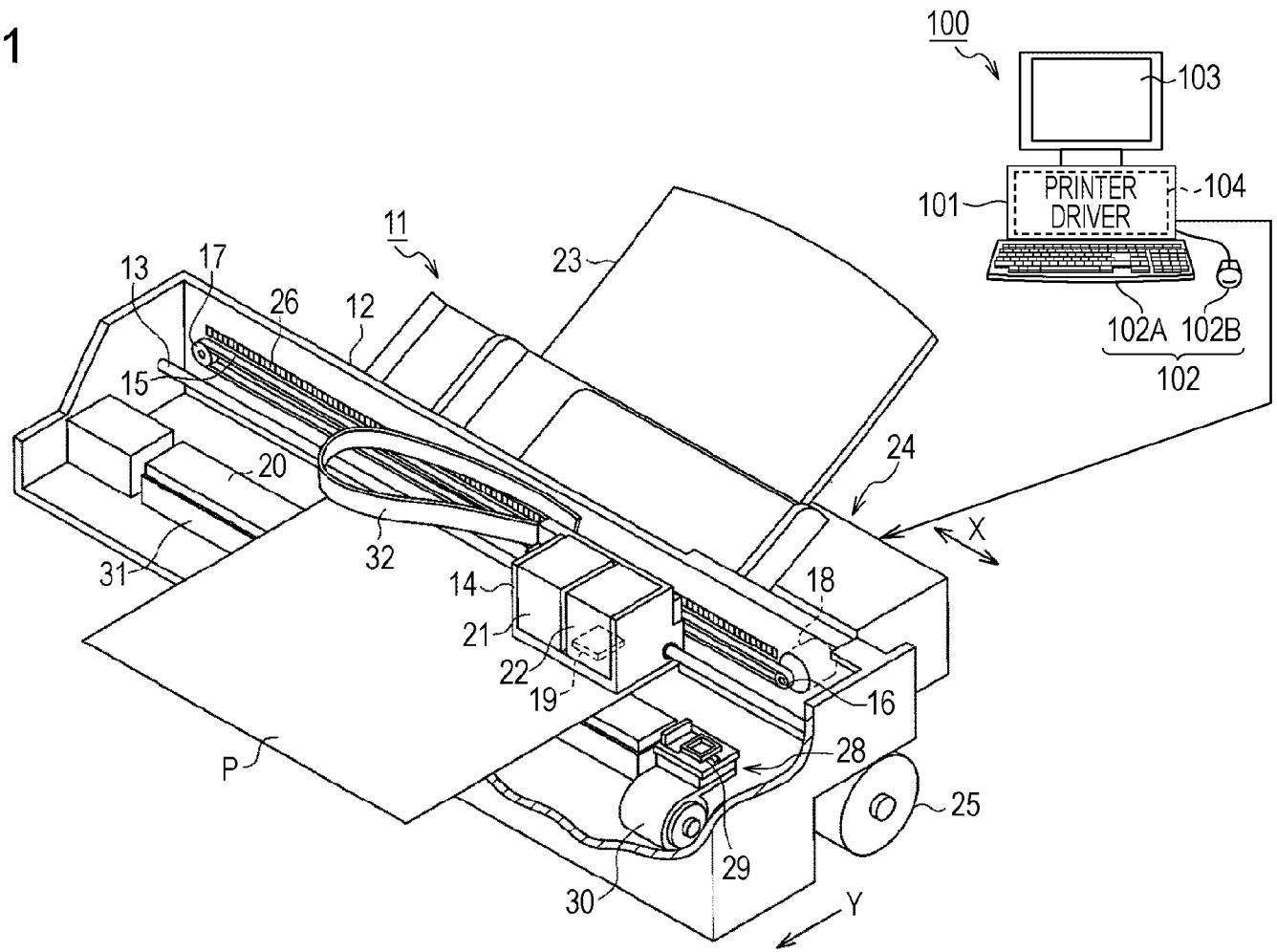
FIG. 1 is a perspective view of a printer in an embodiment in which the invention is embodied.

As shown in FIG. 1, an ink jet printer (hereinafter, simply referred to as a "printer 11") as an example of a recording apparatus is used by, for example, being connected to a host device 100 in a communicatable manner. The host device 100 includes a printer driver 104 in a main body 101 thereof. When a user operates an input device 102 including a keyboard 102A and a mouse 102B, and instructs an application, which displays a document, an image or the like on a monitor 103, to execute the printing of a print target such as the document or the image, the printer driver 104 is started.

The printer driver 104 operates the input device 102, and sequentially performs various processes such as a resolution conversion process, a color conversion process, and a half-tone process on the image data to be printed displayed on the monitor 103, based on the input set printing condition, and creates the print data (image data) of a CMYK color system. Moreover, the printer driver 104 transmits the printing data, which adds the print control command to the print data as a header, to the printer 11. The printer 11 performs the printing of the image or the like based on the printing data received from the host device 100.

The printer 11 shown in FIG. 1 is a serial printer, and is in a state in which an external case is detached therefrom. In a guide shaft 13 built in a main body case 12 having an approximately square box shape with an opened upper side, a carriage 14 is provided in a state of being guided in a main scanning direction (an X direction in FIG. 1) and capable of reciprocating. A timing belt 15 of an endless shape fixed to the back of the carriage 14 is wound around a pair of pulleys 16 and 17 disposed at both of left and right sides on a back plate inner surface of the main body case 12. The carriage motor 18, to which one pulley 16 and the driving shaft are connected, is driven in a forward and backward direction, whereby the carriage 14 is configured so as to reciprocate in the main scanning direction X.

In the lower portion of the carriage 14, a recording head 19 as an example of a recording unit for ejecting ink, which is an example of liquid, is provided. Furthermore, in a lower position facing the recording head 19 in the main body case 12, a support table 20, which regulates a gap between the recording head 19 and the paper P as an example of a recording medium, is arranged in the state of being extended in the X direction. Furthermore, on the upper portion of the carriage 14, a first ink cartridge 21 and a second ink cartridge 22 are loaded in an attachable and detachable manner. The respective ink cartridges 21 and 22 of the embodiment are black ink cartridges and black ink is accommodated therein. The recording head 19 ejects (discharges) the black ink supplied from the respective ink cartridges 21 and 22 from the nozzles formed on a surface opposite to the support table 20. In addition, the loading method of the ink cartridge is not limited to a so-called on-carriage type loaded on the carriage 14 but may be a so-called off-carriage type loaded on a cartridge holder (not shown) provided at the printer main body side. Furthermore, in the embodiment, an example of a first liquid receptor is constituted by the first ink cartridge 21, and an example of a second liquid receptor is constituted by the second ink cartridge 22.

Furthermore, at the back of the printer 11 side, a paper feeding tray 23 and an auto sheet feeder 24 are provided. The auto sheet feeder 24 separates only an uppermost sheet of a plurality of papers P (the paper on the paper feeding tray 23 is omitted from FIG. 1) superimposed on the paper feeding tray 23 and supplies the same to a downstream side in the sub scanning direction Y.

Furthermore, a paper feeding motor 25 disposed in the right side lower portion of the main body case 12 in FIG. 1 is driven, whereby a paper feeding roller and a paper discharging roller (all not shown) are rotated and driven, and the paper P is transported to the downstream side in the sub scanning direction Y. Moreover, by approximately alternately repeating a print operation of ejecting ink from the nozzles of the recording head 19 toward the paper P while causing the carriage 14 to be reciprocated in the main scanning direction X, and a paper feeding operation of transporting the paper P to the downstream side of the sub scanning direction Y by a predetermined amount of transportation, the printing of a character, an image, or the like is performed on the paper P. In addition, in the embodiment, the transport unit is constituted by the paper feeding motor 25, the paper feeding roller, the paper discharging roller or the like.

Furthermore, in the printer 11, a linear encoder 26, which outputs the pulse of a pulse number proportional to the movement distance of the carriage 14, is built so as to be extended along the guide shaft 13. In the printer 11, the speed control and the position control of the carriage 14 are performed based on a movement position, a movement direction, and a movement speed of the carriage 14 that are obtained by the use of the output pulse of the linear encoder 26. Furthermore, a position (a right end position in FIG. 1) of one end side on the movement path of the carriage 14 in the printer 11 is a home position. Immediately below the carriage 14 upon being in the home position, a maintenance device 28 is disposed which performs the cleaning for preventing and eliminating nozzle clogging or the like of the recording head 19.

The maintenance device 28 shown in FIG. 1 raises the cap 29 provided so as to be movable up and down until coming into contact with a nozzle forming surface (for example, a lower surface) of the recording head 19, drives the suction pump 30 in that contact state, and imparts negative pressure in the inner portion of the cap 29, thereby forcibly suctioning ink from the nozzles of the recording head 19. Due to the ink suction, the cleaning is performed by which the thickening ink in the nozzles, the air bubbles in the ink flow path or the like is discharged and removed into the cap 29 together with ink. The waste ink suctioned and discharged into the cap 29 is discharged to a waste liquid tank 31 arranged at the lower side of the support table 20 by the driving of the suction pump 30. In addition, the recording head 19 is electrically connected to a controller of the printer main body side via a flexible flat cable (hereinafter, called "FFC32").

Next, an arrangement pattern of the nozzle row in the recording head 19 and an ink supply system to the recording head 19 will be described using FIG. 2.

Figure 2:
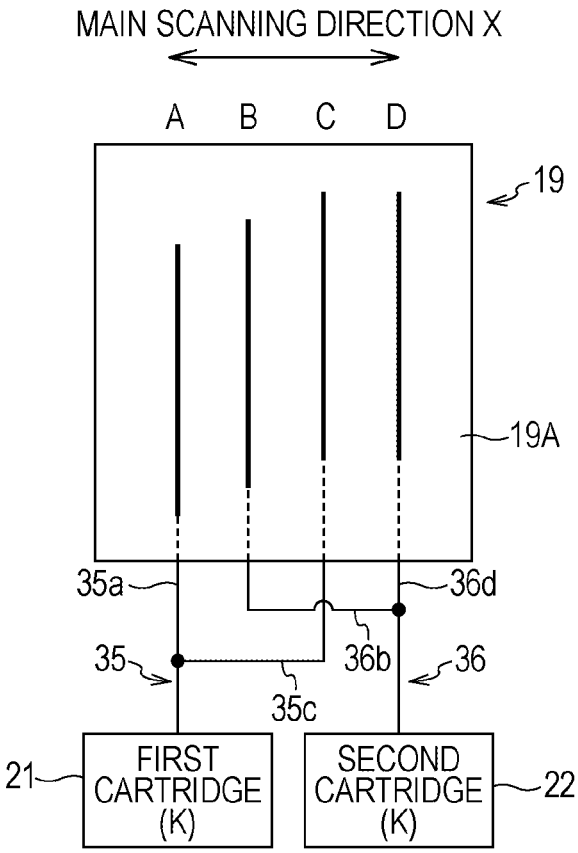
FIG. 2 is a schematic diagram that shows an ink supply system that supplies a recording head with ink.

As shown in FIG. 2, the bottom surface of the recording head 19 is a nozzle forming surface 19A in which a plurality of nozzles is opened. On the nozzle forming surface 19A, a total of four nozzle rows A to D are formed which are configured by 180 nozzles in total arranged in a row in the sub scanning direction (an up and down direction in FIG. 2) at a certain nozzle pitch.

The first ink cartridge 21 is connected to the nozzle rows A and C through the first flow path 35 including the flow path in the recording head 19 and the flow path in the carriage 14. Furthermore, the second ink cartridge 22 is connected to the nozzle rows B and D through a second flow path 36 including the flow path in the recording head 19 and the flow path in the carriage 14. Ink from the first ink cartridge 21 is supplied to the nozzle row A through the flow path 35*a*, and is supplied to the nozzle row C through the flow path 35*c*. Furthermore, ink from the second ink cartridge 22 is supplied to the nozzle row B through the flow path 36*b* and is supplied to the nozzle row D through the flow path 36*d*.

Figure 3:
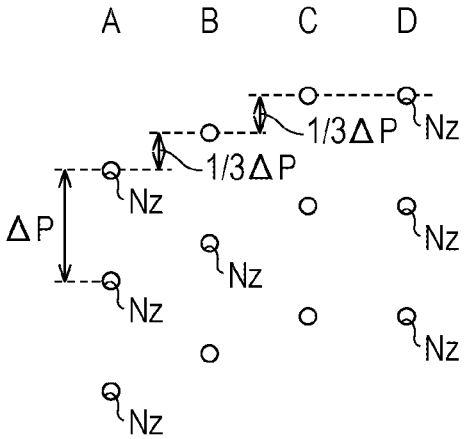
FIG. 3 is a perspective view that shows a nozzle arrangement.

As shown in FIG. 3, nozzles Nz constituting the respective nozzle rows A to D are arranged along the sub scanning direction Y at an interval of a certain nozzle pitch ΔP. In the embodiment, by setting the nozzle pitch to ΔP, it is possible to perform the printing one nozzle row at a time at a printing resolution of 120 dpi.

With respect to the nozzles Nz constituting the nozzle row A, the nozzles Nz constituting the nozzle row B are offset to the upstream side (the upper side in FIG. 2) of the sub scanning direction Y by ⅓ pitch of the nozzle pitch. Furthermore, with respect to the nozzles Nz constituting the nozzle row B, the nozzles Nz constituting the nozzle row C are offset to the upstream side of the sub scanning direction Y by ⅓ pitch of the nozzle pitch. Moreover, by performing the printing using three nozzle rows A to C, the printing of 360 dpi is possible. That is, by disposing N (N is a natural number equal to or greater than 2) nozzle rows so as to be shifted in the sub scanning direction Y by 1/N of the nozzle pitch ΔP, it is possible to perform the printing at a printing resolution (360 dpi in the embodiment) of N-times the printing resolution (120 dpi in the embodiment) per one nozzle row.

Herein, the ink cartridges 21 and 22 of the embodiment have an ink supply capability of 1.5 rows by the conversion of the nozzle row. Thus, in the embodiment, by adding one more nozzle row D having the same nozzle position as one nozzle row C in the sub scanning direction Y to three nozzle rows A, B, and C that are arranged so that the printing of 360 dpi is possible, in total four nozzle rows are set.

Moreover, in the embodiment, the first ink cartridge 21 supplies ink of an amount of 1.5 rows corresponding to the sum of one row of the nozzle row A and the 0.5 row of the nozzle row C. That is, the nozzles Nz of one row of the nozzle row A and the nozzles Nz of 0.5 row of the nozzle row C are use nozzles used in the printing. Furthermore, the second ink cartridge 22 supplies ink of an amount of 1.5 rows corresponding to the sum of one row of the nozzle row B and the 0.5 row of the nozzle row D. That is, the nozzles Nz of one nozzle of the nozzle row B and the nozzles Nz of 0.5 row of the nozzle row D are use nozzles. Herein, the use nozzles refer to the nozzles used in the printing. However, whether or not ink droplets are actually ejected from the use nozzles depends on the image data.

Herein, when the ink cartridge is generalized in the case of M, J nozzle rows for obtaining a predetermined printing resolution of J-times the pixel pitch of the nozzle pitch ΔP is provided. The J nozzle rows are provided so that the positions of the nozzles of the different rows are shifted by ΔP/J in the sub scanning direction Y. When one of the J nozzle rows is the first nozzle row, the second nozzle row having the same positions of the nozzles as the first nozzle row in the sub scanning direction Y is provided in a position different from the J nozzle row in the main scanning direction X.

(J−1) nozzle rows except for the first nozzle row among the J nozzle rows are divided by an M set nozzle row group having the same number as the ink cartridge. The numbers of the nozzle rows belonging to each set may be identical to each other and may be different from each other. Moreover, the M set nozzle row group is connected to the M ink cartridge so that another ink cartridge corresponds to one set. In the example of the embodiment, two (M) nozzle rows A and B except for the nozzle row C (the first nozzle row) among three nozzle rows A to C for obtaining a predetermined printing resolution (360 dpi) are connected to the different ink cartridges 21 and 22, respectively. For example, when J=4, three nozzle rows except for the first nozzle row among them may be connected to three ink cartridges, or when J=5, two sets of nozzle row groups dividing four by two except for the first nozzle row among them may be connected to two ink cartridges.

Furthermore, (M−1) (for example, the second nozzle row, . . . , the M nozzle row) nozzle rows having the same positions of the nozzles in the sub scanning direction as the first nozzle row are added. As a result, the nozzle rows (the first nozzle row, the second nozzle row, . . . , the M nozzle row) having the same positions of the nozzle rows in the sub scanning direction are set to M that is the same as the number of the ink cartridges. Since the embodiment is an example of M=2, the M nozzle rows are two of the first nozzle row (the nozzle row C) and the second nozzle row (the nozzle row D). Since it is assumed that there is a plurality of ink cartridges (M≧2), the M nozzle row includes at least two nozzle rows of the first nozzle row and the second nozzle row.

In the case of the normal printing mode in which ink is present in all of the M ink cartridges, when performing the printing of a predetermined printing resolution by the use of the J nozzle rows among (J+M−1) nozzle rows, the (M−1) nozzle rows having the same positions of the nozzles as the first nozzle row, which is one of them, in the sub scanning direction are not used. Ink in the nozzles is ejected and is sequentially replaced with new ink, whereby the thickening and the drying thereof are drastically avoided, which contributes to the prevention of clogging of the nozzles. For this reason, in the embodiment, the printing is performed of one nozzle row by the use of the first nozzle row to the M-th nozzle row (M≧2) without using only the first nozzle row. For example, the printing of one nozzle row by using the first nozzle row to the M-th nozzle row by 1/M row. Furthermore, one of the first nozzle row to the M-th nozzle row is set to the use nozzle row, and the printing is performed while sequentially switching the use nozzle row. Of course, even in the case of the configuration in which 1/M row is used, the nozzle positions of the used 1/M row are sequentially switched between the first nozzle row and the M-th nozzle row, so that the non-used nozzles are not generated. In addition, compared to the configuration in which nozzle rows are switched and used by one row, a configuration, in which the nozzle rows are used by 1/M row, has a low ink cartridge ink supply capability, whereby it is possible to realize more stable ink supply.

Furthermore, in a case where the M nozzle rows are equal to or greater than three, when there are two or more ink cartridges in which ink is not depleted (liquid is not depleted), it is desirable to perform the printing of one nozzle row while switching two or more first nozzle rows to F-th nozzle rows (F is a natural number equal to or less than "M−1") corresponding to two or more ink cartridges.

Meanwhile, when Q (Q is a natural number equal to or less than (M−1)) among the M ink cartridges is determined as the ink end, since it is difficult to use one of the J nozzle rows, it is difficult to perform the printing of a predetermined printing resolution (360 dpi in the present example) by one scanning (1 pass) of the carriage 14 (in other words, the recording head 19). In this case, when it is possible to effectively realize the printing of a predetermined printing resolution by the use of (J−Q) nozzle rows in which Q is subtracted therefrom, compared to the case of using only one nozzle row, the printing using the (J−Q) nozzle row is performed. When the printing of a predetermined printing resolution cannot be realized even in the case of using the (J−Q) nozzle row, or when (J−Q) becomes one, the printing of one nozzle row is performed by the use of the first to the M-th nozzle rows having the same positions of the nozzles in the sub scanning direction Y, without using one of J having the different positions of the nozzles in the sub scanning direction Y. That is, the printing of the one nozzle row (120 dpi in the embodiment) is performed by the use of the first to M-th nozzle rows by one scanning (1 pass) of the carriage 14. The paper feeding of this time realizes a predetermined printing resolution (360 dpi) by performing the paper feeding of M times by a paper feeding pitch of 1/M of the paper feeding pitch of the normal printing mode. Moreover, the paper feeding is performed by a paper feeding amount corresponding to the nozzle row length (a length corresponding to 180 nozzles in the present example) at the rate of one time per M time. In addition, in the embodiment, the printing mode is called a "slow printing mode".

In the embodiment, a part of one row of the nozzle rows is set to the use nozzle, the positions of the respective use nozzles are switched for each of a predetermined interval between the M nozzle rows, and the switching is performed for a predetermined time, with the result that all of the nozzles of the M nozzle rows become the use nozzles once. In this manner, by the switching of the use nozzles, it is possible to avoid only a particular nozzle being used, and the clogging of the unused nozzles is also hardly generated. Furthermore, the used ejection driving element 38 is not limited to a particular element, and it is also possible to extend the use life.

In the embodiment, as an example, 1/M rows are set as the use nozzles to the M nozzle rows. Moreover, the use nozzles of 1/M row are selected so that the mutual positions are different from each other between the M nozzle rows in the sub scanning direction Y. An object of dividing by 1/M row is to reduce the irregularity of each ink amount that is supplied from the M ink cartridge to the recording head 19, respectively. In other words, a certain upper limit exists in the ink supply capability of the ink cartridge, and by making the number of the use nozzle taking charge of the ink supply place substantially identical between the M ink cartridges, the maximum ink supply amount of each ink cartridge is averaged. As a result, ink is stably supplied from the M ink cartridges within the ink supply capability, whereby the ink ejection of the recording head 19 is stably performed.

In the case of an example of M=2 shown in FIGS. 1 and 2, the nozzle row D is added in which all of the nozzles are in the same position as the nozzle row C in the sub scanning direction Y, and two nozzle rows C and D are connected to two ink cartridges 21 and 22, respectively. Moreover, half (0.5 rows) nozzles are set as the use nozzle by the respective nozzle rows C and D so that ink of the amount corresponding to 0.5 rows from two ink cartridges in the conversion of the nozzle row can be supplied respectively. In this case, the use nozzle is set so as to become half (0.5 rows) having the positions different from each other in the sub scanning direction Y.

Figure 6A:
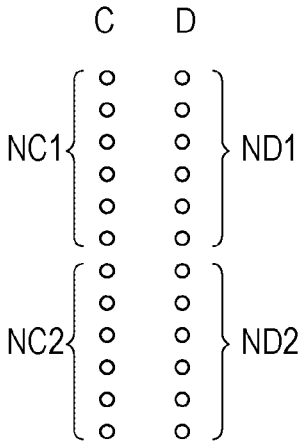
FIGS. 6A and 6B are schematic diagrams that show each nozzle group in which nozzle rows are divided.
Figure 6B:
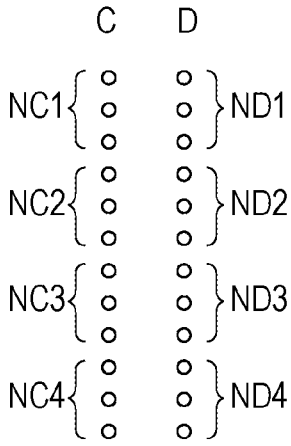

FIGS. 6A and 6B show an example of a method of dividing the use nozzle by 0.5 rows between the nozzle rows C and D. There are two kinds of dividing methods shown in FIGS. 6A and 6B. In addition, in FIGS. 6A and 6B, in order to facilitate the description, the number of the nozzles of one nozzle row is 12 which is smaller than the actual 180.

In the example shown in FIG. 6A, the nozzle row C is divided into a first nozzle group NC1 including an upstream half number of nozzles and a second nozzle group NC2 including a downstream half number of nozzles in the sub scanning direction Y. Furthermore, the nozzle row D is also divided into a first nozzle group ND1 including an upstream half number of nozzles and a second nozzle group ND2 including a downstream half number of nozzles in the sub scanning direction Y.

Figure 7A:
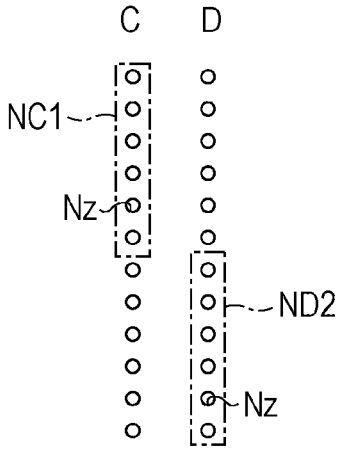
FIGS. 7A and 7B are schematic diagrams that show use nozzles in a normal printing mode.
Figure 7B:
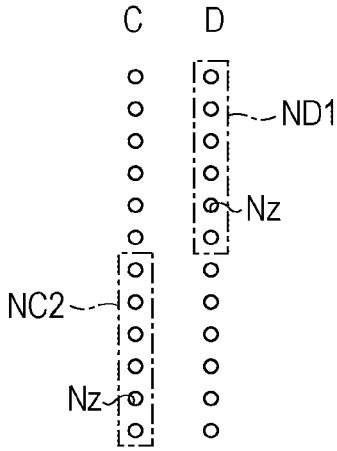

Moreover, as shown in FIGS. 7A and 7B, the use nozzles are determined by a combination (a region surrounded by an alternate long and short dashed line of FIG. 7A) of the first nozzle group NC1 and the second nozzle group ND2 or a combination (a region surrounded by an alternate long and short dashed line of FIG. 7B) of the second nozzle group NC2 and the first nozzle group ND1. The nozzles of the half number having the nozzle positions different form each other between the nozzle row C and the nozzle row D in the sub scanning direction Y are set to the use nozzles, so that the printing of one nozzle row can be performed by the nozzle rows C and D altogether. Moreover, the use nozzle group can be alternately switched for each prescribed interval between the nozzle rows C and D.

Figure 8A:
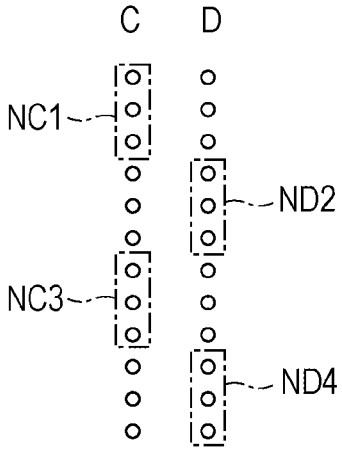
FIGS. 8A and 8B are schematic diagrams that show use nozzles in the normal printing mode according to an example different from FIGS. 7A and 7B.
Figure 8B:
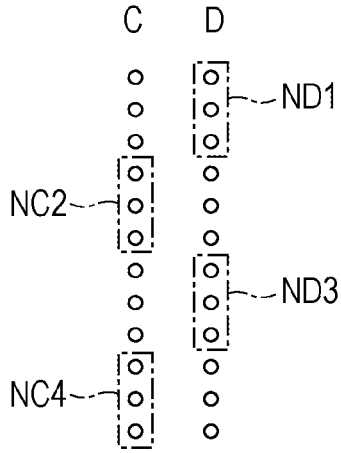

Of course, like the example shown in FIG. 6B, it may be possible to adopt a dividing method of dividing the nozzle rows C and D into four regions of a first nozzle group to a fourth nozzle group NC1 to NC4, and ND1 to ND4 in the sub scanning direction Y, without being limited to the configurations shown in FIGS. 6A, 7A and 7B. In this case, as shown in FIGS. 8A and 8B, among four nozzle groups in which the nozzle rows C and D are divided, respectively, the nozzle groups are divided by each of two nozzle rows, and each of two nozzle groups are set to the use nozzles. Moreover, as shown in FIGS. 8A and 8B, the use nozzles are determined by a combination (a region surrounded by an alternate long and short dashed line of FIG. 8A) of the nozzle groups NC1 and NC3 and the nozzle groups ND2 and ND4 or a combination (a region surrounded by an alternate long and short dashed line of FIG. 8B) of the nozzle groups NC2 and NC4 and the nozzle groups ND1 and ND3. Moreover, the use nozzle group is alternately switched between the nozzle rows C and D for each of a predetermined interval.

Herein, in the embodiment, the predetermined interval is set, for example, to an interval for each printing page. Of course, it may be possible to adopt an interval for each of a predetermined number of passes when the carriage 14 finishes G (G is a natural number) scanning (P pass), an interval for each of a plurality of printing pages, an interval for each operation or the like.

Figure 4:
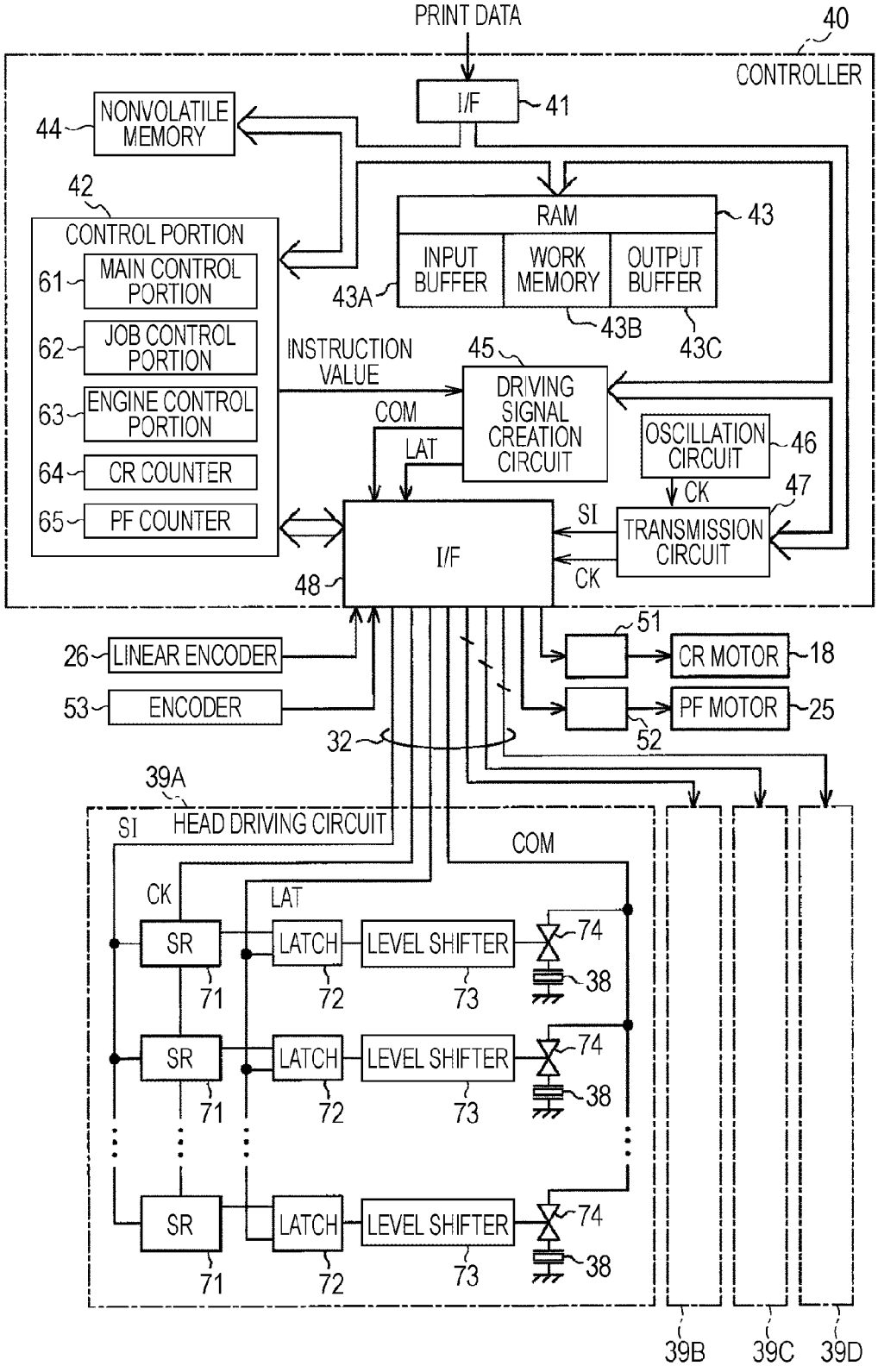
FIG. 4 is a block diagram that shows an electrical configuration and a partial function configuration of the printer.

Next, an electrical configuration of the printer 11 will be described. FIG. 4 is a block diagram that shows an electrical configuration of the printer. As shown in FIG. 4, the printer 11 includes a controller 40. The controller 40 is constituted by a CPU (central processing unit) installed on a circuit board in the present example, an ASIC (application Specific IC)), a ROM, a RAM or the like.

The controller 40 includes an external interface (hereinafter, called an "external I/F 41") that receives the print data from the host device 100 (see FIG. 1), a control portion 42 formed of the CPU or the like, a RAM 43 for temporarily memorizing various controlling data or storing the print data, and a nonvolatile memory 44. In addition, the print data is transmitted to the external I/F 41 by one column (one pass) of the recording head 19.

The RAM 43 is used as an input buffer 43A, a work memory 43B and an output buffer 43C (an image buffer). In the input buffer 43A, the print data received by the external I/F 41 is temporarily stored. The printing data includes command information and printing image data. The control portion 42 interprets the command information, performs a predetermined image process or the like on the printing image data to create the print data, and develops the created print data in the output buffer 43C. In addition, in the work memory 43B, the processing data of the printing image data or the like is temporarily stored.

Furthermore, the controller 40 includes a driving signal creation circuit 45 (a trapezoidal wave creation circuit) that creates the driving signal of the trapezoidal wave defined by the command value from the control portion 42, an oscillation circuit 46 that generates the clock CK, a transmission circuit 47 that transmits the print data or the like, and an interface (hereinafter, called an internal I/F 48). For example, the driving signal creation circuit 45, the oscillation circuit 46, and the transmission circuit 47 are provided in the ASIC.

Furthermore, the control portion 42 drives and controls the carriage motor 18 (described as a "CR motor" in FIG. 4) and the paper feeding motor 25 (described as a "PF motor" in FIG. 4) via the motor driving circuits 51 and 52 connected to the internal I/F 48, respectively. In addition, the control portion 42 inputs the respective encoder pulse signals from the linear encoder 26 and an encoder 53 connected to the internal I/F 48.

The control portion 42 instructs the transmission circuit 47 to transmit the print data developed in the output buffer 43C. The transmission circuit 47 transmits the clock CK from the oscillation circuit 46, the print data SI from the output buffer 43C or the like to the head driving circuits 39A to 39D of the recording head 19 side via the internal I/F 48 and FFC 32 at a predetermined timing one nozzle row at a time, based on the instruction from the control portion 42. The driving signal creation circuit 45 creates a driving signal COM, a latch signal LAT or the like, based on the instruction (a trigger signal) from the control portion 42. The driving signal COM, the latch signal LAT or the like created by the driving signal creation circuit 45 are transmitted to the head driving circuits 39A to 39D of the recording head 19 side via the internal I/F 48 and FFC 32. Herein, the head driving circuits 39A to 39D correspond to the nozzle rows A to D, respectively, and drive and control the ejection driving element 38 for each of the nozzles constituting the nozzle rows A to D, respectively. In addition, in the embodiment, the head driving circuits 39A to 39D correspond to an example of the driving systems that are the destinations of the recording data. Furthermore, the head driving circuit 39C corresponds to the driving system of the first nozzle row (the nozzle row C in the present example), and the head driving circuit 39D corresponds to the second nozzle row (the nozzle row D in the present example).

Herein, the driving signal COM created by the driving signal creation circuit 45 is a pulse signal that includes at least one pulse of the wave form having a predetermined amplitude within the printing period corresponding to the period of one dot. Herein, the printing period TA corresponds to the period when the recording head 19 prints one dot in the main scanning direction.

Print data SI is constituted by the dot data of multi-gradations (for example, two gradation, four gradation or the like). Among a plurality of pulses included in the driving signal COM, the pulse corresponding to the bit value of the print data SI is selected. The driving voltage proportional to the selected pulse is applied to the ejection driving element 38, whereby the ink droplets are ejected from the nozzles. For example, when the print data SI is the dot data of four gradations, among the plurality of pulses included in the driving signal COM, the pulse corresponding to the bit value of the print data SI is selected, For example, when the bit value is "00", a minute vibration pulse is selected, and the minute vibration is applied to ink in the nozzles. When the bit value is "01", a small pulse is selected, and the ink droplet of a small dot is ejected. When the bit value is "10", a large pulse is selected, and the ink droplet of a large dot is ejected. Furthermore, when the bit value is "11", both of the small pulse and the large pulse are selected, and the ink droplet of a large dot is ejected. In addition, it is possible to adopt two gradations by setting the bit value to one bit or adopt the print data SI and the driving signal COM of the multi-gradation values exceeding four gradations as three bits.

As shown in FIG. 4, the control portion 42 includes a main control portion 61, a job control portion 62, an engine control portion 63, a CR counter 64, and a PF counter 65. In the embodiment, the respective portions 61 to 63 are constituted by software that is established by executing the program in the ROM by the CPU on the circuit board. Of course, the respective portions 61 to 63 can also be constituted by hardware such as an integrated circuit or can also be established by the cooperation between the hardware and the software.

Herein, the functions of the main control portion 61, the job control portion 62 and the engine control portion 63 will be described using FIGS. 4 and 5.

The main control portion 61 is situated at a high rank on the control of the job control portion 62 and the engine control portion 63, receives the notification from the engine control portion 63, performs various processes based on the received notification, or sends the data of the process result to the job control portion 62. Furthermore, the main control portion 61 creates the print data based on the printing image data of the print data, and transmits the created print data to the job control portion 62. Specifically, the main control portion 61 performs a predetermined image process or the like on the printing image data of the printing data stored in the input buffer 43A of the RAM 43 to create the print data, and develops the created print data in the output buffer 43C. Moreover, the main control portion 61 requires the job control portion 62 to start the printing control based on the print data.

The job control portion 62 transmits the print data received from the main control portion 61 to the engine control portion 63 at a suitable timing. Specifically, when receiving the request for the starting of the printing control from the main control portion 61, the job control portion 62 sends the print driving start request for performing the print driving of the recording head 19 to the engine control portion 63 based on the print data developed in the output buffer 43C.

Furthermore, when receiving the print driving start request from the job control portion 62, the engine control portion 63 instructs the transmission circuit 47 to transmit the print data to the head driving circuit 39 in the recording head 19. Specifically, the engine control portion 63 instructs the transmission circuit 47 to transmit the print data SI of one pass stored in the output buffer 43C to the head driving circuit 39, thereby setting the print data SI of one pass to a shift register 71 in the head driving circuit 39. By setting the print data to the respective shift registers 71, the engine control portion 63 executes the printing by the recording head 19.

Figure 5:
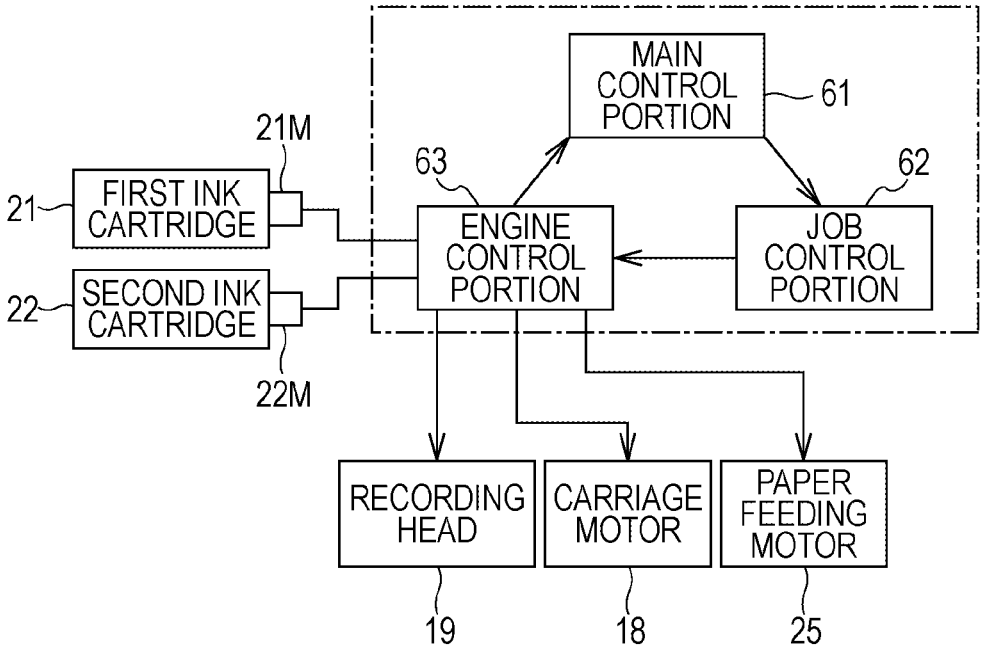
FIG. 5 is a block diagram that shows a control system in the printer.

Furthermore, as shown in FIG. 5, the engine control portion 63 is electrically connected to memory elements 21M and 22M mounted on ink cartridges 21 and 22 via each terminal (not shown), whereby the writing and the reading of the data relative to the respective memory elements 21M and 22M are possible. Furthermore, the engine control portion 63 has a function of acquiring the ink residual amounts of the respective ink cartridges 21 and 22. The engine control portion 63 of the embodiment counts the dot number ejected by the recording head 19 based on the print data, and calculates the present amount of consumption of ink based on the counted dot number. Moreover, the engine control portion 63 sequentially calculates the current (present) ink residual amount by subtracting the present amount of consumption of ink from the last ink residual amount. Moreover, when the power source of the printer 11 is cut off, the current ink residual amount is memorized in the memory elements 21M and 22M, the ink residual amount, when the last power source is cut off, is acquired from the memory elements 21M and 22M when the next power source is input, and the amount of consumption of ink based on the dot number is sequentially subtracted from the ink residual amount, thereby acquiring the current ink residual amount. Moreover, when the current ink residual amount is equal to or less than a predetermined ink depletion value, it is determined that ink is depleted in the ink cartridge. Of course, a configuration may be adopted in which an ink depletion sensor (not shown) is provided in the ink cartridges 21 and 22 to determine whether or not ink is depleted in the respective ink cartridges based on the detection result of the ink depletion sensor. When it is determined that ink is depleted, the engine control portion 63 notifies the gist of the ink depletion together with information (for example, a cartridge number) capable of specifying the ink cartridge, in which ink is depleted, to the main control portion 61.

The main control portion 61 also manages the printing mode, whereby, when ink is not depleted in all of the respective ink cartridges 21 and 22, the main control portion 61 sets "normal printing mode", and when ink is depleted in one of the respective ink cartridges 21 and 22, the main control portion 61 sets "slow printing mode". In the "normal printing mode", ink is supplied from two ink cartridges 21 and 22 to the nozzle rows A to D, thereby performing the printing. At this time, the main control portion 61 creates the print data of the four nozzle rows A to D.

Figure 9A:
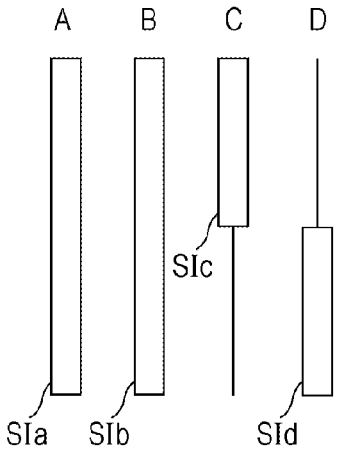
FIGS. 9A and 9B are schematic diagrams that show an allocating method of a print data in the normal printing mode.
Figure 9B:
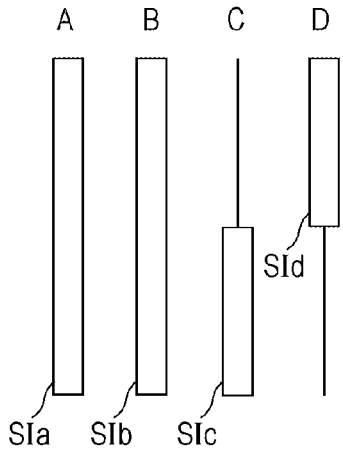
Figure 10A:
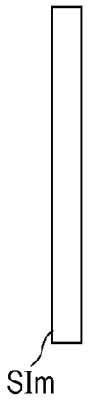
FIG. 10A to 10C are schematic diagrams that show an allocating method of the print data in a slow printing mode.
Figure 10B:
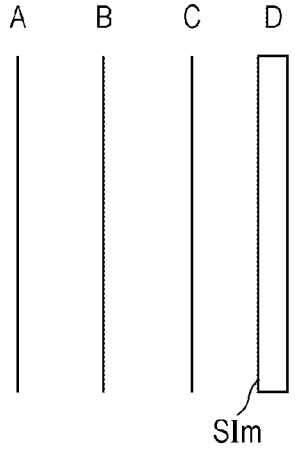
Figure 10C:
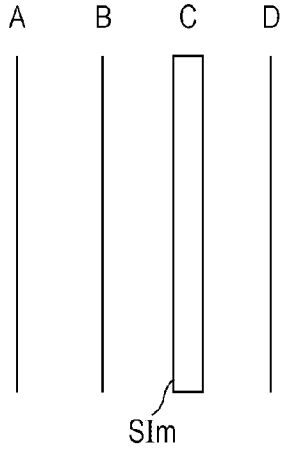

FIGS. 9A to 10C show the print data that is created in the respective printing modes by the main control portion 61. FIGS. 9A and 9B show the print data of four rows that is created during normal printing mode, and FIGS. 10A to 10C show the print data of one row that is created during slow printing mode. In addition, in FIGS. 9A to 10C, outlined portions are data portions to be printed (ejected), and solid lines are data portions that are not printed.

In the normal printing mode shown in FIGS. 9A and 9B, the print data of one row is created in the nozzle row A and the nozzle row B. The print data of 0.5 row is created in the nozzle row C and the nozzle row D. The print data of each of 0.5 row of the nozzle row C and the nozzle row D are created so that the positions of the use nozzles between the nozzle rows C and D are mutually complementary. Moreover, in the embodiment, the print data is created so as to alternately switch the data of 0.5 rows of the nozzle rows C and D between the nozzle rows C and D for each printing page.

At the time of the normal printing mode shown in FIGS. 9A and 9B, print data SIa of one row for the nozzle row A, print data SIb of one row for the nozzle row B, print data SIc of 0.5 row for the nozzle row C, and print data SId of 0.5 row for the nozzle row D are created by the main control portion 61. Both of the print data SIc and SId of 0.5 row of the nozzle rows C and D are one row nozzle. In addition, in the embodiment, the print data SIa, SIb, SIc, and SId shown in FIGS. 9A and 9B correspond to the first recording data.

Moreover, as shown in FIG. 9A, when a switching flag=1, the data of the upstream side 0.5 row corresponding to the first nozzle group NC1 as the print data SIc for the nozzle row C is set, and the data corresponding to the downstream side 0.5 row corresponding to the second nozzle group ND2 as the print data SId for the nozzle row D is set. Furthermore, as shown in FIG. 9B, when the switching flag=0, the data of the downstream side 0.5 row corresponding to the second nozzle group NC2 as the print data SIc for the nozzle row C is set, and the data of the upstream side 0.5 row corresponding to the first nozzle group ND1 as the print data SId for the nozzle row D is set. In addition, both of the data SIc and SId are divided by 0.5 row so as to become one nozzle row, but the dividing method (the nozzle row dividing method) is not limited to the upstream half and the downstream half, and the method of dividing by 0.5 row can suitably be changed as long as the mutually complementing relationship is satisfied.

FIG. 6B is an example in which the nozzle rows C and D are divided into four nozzles of the first nozzle group to the four nozzle group NC1 to NC4, and ND1 to ND4. The use nozzles are divided into a combination (a combination of an odd number nozzle group) of the first nozzle group and the third nozzle group and a combination (a combination of an even number group) of the second nozzle group and the fourth nozzle group. That is, the use nozzle groups are alternately set among the first to fourth nozzle groups. Moreover, the main control portion 61 creates the print data so as to switch the use nozzle group used in the printing between the nozzle rows C and D wherever one page is printed.

Meanwhile, in the "slow printing mode", the nozzle row C or the nozzle row D, in which ink is not depleted, among all the ink cartridges 21 and 22 are selected as the use nozzles, and the printing is performed by the use of only one nozzle row of the nozzle rows C and D. At this time, as shown in FIG. 10A, the main control portion 61 creates the print data SIm of one nozzle row regardless of which side of the nozzles row C and the nozzle row D is the use nozzle row. This is because the nozzle row C and the nozzle row D have the same position of the respective nozzles in the sub scanning direction Y, and the normal print data of one nozzle row can be used. Moreover, as shown in FIG. 10A, when ink is depleted in the first ink cartridge 21, the print data SIm is set to the driving system of the nozzle row D. Furthermore, as shown in FIG. 10B, when ink is depleted in the second ink cartridge 22, the print data SIm is set to the driving system of the nozzle row C. In addition, in the embodiment, the print data SIm shown in FIG. 10A corresponds to the second recording data.

The CR counter 64 sets a home position of the carriage 14 as an original point, adds the input pulse number from the linear encoder 26 in the process in which the carriage 14 is moved in a direction separated from the home position, and subtracts the input pulse number in the process in which the carriage 14 is moved in a direction approaching the home position, thereby counting the carriage position in the main scanning direction X. The control portion 42 instructs the object speed instruction values (for example, object frequency instruction values) to the motor driving circuit 51 depending on the carriage positions at that time based on the count number of the CR counter 64, thereby performing the speed control and the stop control of the carriage motor 18.

The PF counter 65 is reset in the detection position of the sensor, which detects the proximal end of the paper while the paper is loaded, or a standard position transported therefrom by a predetermined amount, and then counts the input pulse number from a transport roller (not shown) or a rotary encoder (not shown) provided in the rotation shaft connected therewith, thereby counting the transport position of the paper relative to the standard position. The control portion 42 instructs the object speed instruction value depending on the transport positions of each such time based on the count number value of the PF counter 65 to the motor driving circuit 52, and drives and controls the paper feeding motor 25, thereby performing the transport control of the paper.

In addition, the head driving circuit 39 selects the selection/non-selection of the driving pulse of the driving signal depending on the print data, and the ejection driving element 38, to which the driving pulse is input, is driven, whereby the ink droplets are ejected from the respective corresponding nozzles.

Next, the configuration of the head driving circuit 39 connected to the controller 40 via the FFC 32 will be described. The head driving circuit 39 includes a shift register 71, a latch circuit 72, a level shifter 73, and a switching element 74 for each ejection driving element 38.

The respective dot data of the print data SI of one nozzle row synchronized with the clock CK from the oscillation circuit 46 is input to the respective shift registers 71, respectively. For example, when one dot has two gradations, the print data SI includes 180 (one nozzle row) dot data rows taking dot values "0" and "1", and when one dot has four gradations, the print data SI includes 180 dot data rows taking dot values "00", "01", "10", and "11". In addition, in the case of four gradations, the shift register 71 includes the shift registers of the same number (two) as the bit number of the dot data, and a high rank bit and a low rank bit are input to the respective shift registers.

The latch circuit 72 latches the data set in the shift register 71 based on the latch signal LAT which is input at a predetermined timing.

Furthermore, the head driving circuit 39 is provided with a control logic (not shown) which outputs the value corresponding to the data input from the latch circuit 72 to the level shifter 73 for each timing of the first period and the second period divided from the printing period PA into two. In a case where one dot has two gradations, when the data "1" is input from the latch circuit 72, the control logic outputs "1" at the first period and "0" at the second period, and when the data "0" is input, the control logic outputs "0" at the first period, and "1" at the second period. Furthermore, when the print data SI has four gradations, the control logic outputs the output data which is defined from the combination of the data from each latch circuit at the timing for each period divided from the printing period TA into three. When the data from the control logic is "1", the level shifter 73 makes the switching element 74 be in the connection state, and when the data from the control logic is "0", the level shifter 73 makes the switching element 74 be in the non-connection state.

When the data from the control logic is "1", the level shifter 73 raises the supply voltage to the switching element 74 up to a predetermined voltage value (for example, tens of volts), and makes the switching element 74 be in the connection state. Meanwhile, when the data from the control logic is "0", the level shifter 73 does not raise the supply voltage, and makes the switching element 74 be in the non-connection state.

The switching element 74 inputs the driving signal COM created by the driving signal creation circuit 45 for each printing period in the process in which the carriage 14 passes once for the printing. Thus, when the bit value of the dot data is "00", the pulse for the minute vibration of the driving signal COM is applied to the ejection driving element 38, and ink in the nozzles is minutely vibrated. Furthermore, when the bit value is "01", the small pulse is applied to the ejection driving element 38, and the ink droplets of the small dots are ejected. Furthermore, when the bit value is "10", the large pulse is applied to the ejection driving element 38, and the ink droplets of the medium dots are ejected, and when the bit value is "11", both of the small pulse and the large pulse are applied to the driving element 38, and the ink droplets of the large dots are ejected.

In addition, in the embodiment, the ejection driving element 38 is constituted by, for example, a piezoelectric vibration element or an electrostatic driving element. Of course, the ejection driving element 38 may be a heater that heatsink in the nozzle passages, and it is also possible to adopt a thermal method that discharges the ink droplets from the nozzles by the use of the expansion of the air bubble generated by the boiling in ink heated by the heater.

Figure 11:
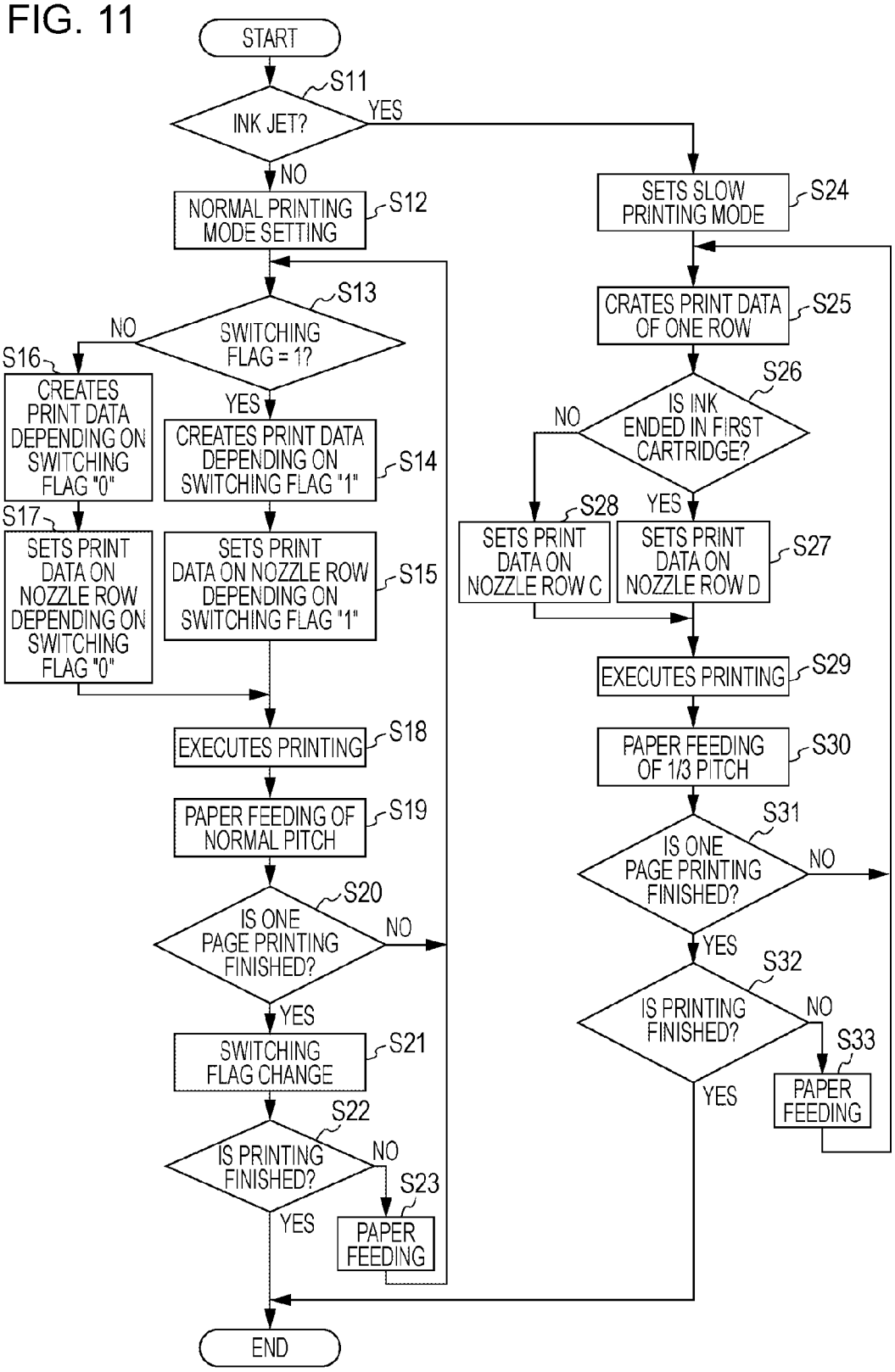
FIG. 11 is a flowchart that shows a print process routine.

Next, the process of the printer 11 in the embodiment will be described according to a flowchart shown in FIG. 11.

Firstly, in step S11, it is determined whether or not ink is depleted. If ink is not depleted, the normal printing mode is set (step S12), and if ink is depleted, the slow printing mode is set (step S24). In addition, in the embodiment, the determination process of step S11 corresponds to a determination step of determining whether or not liquid is depleted. Furthermore, an example of the determination unit is constituted by the engine control portion 63 that performs the process of step S11.

When the normal printing mode is set, by performing the processes of steps S13 to S23, the printing of the normal printing mode is performed by the use of the all nozzle rows A to D connected to all the ink cartridges 21 and 22. Meanwhile, when the slow printing mode is set, by performing the processes of steps S25 to S33, the printing of the slow printing mode is performed by the use of the nozzle row C or the nozzle row D connected to the ink cartridge in which ink is not depleted among all the ink cartridges 21 and 22.

Firstly, the printing of the normal printing mode will be described based on steps S13 to S21.

When the normal printing mode is set, in the next step S13, it is determined whether or not a switching flag=1. If the switching flag=1, the process proceeds to step S14, and the print data depending on the switching flag "1" is created. That is, the print data SIa, SIb, SIc, and SId shown in FIG. 9A are created. Meanwhile, if the switching flag=0, the process proceeds to step S16, and the print data depending on the switching flag "0" is created. That is, the print data SIa, SIb, SIc, and SId shown in FIG. 9B are created.

When the print data depending on the switching flag=1 is created, in the next step S15, the print data is set to the nozzle rows depending on the switching flag "1". That is, the print data SIa and SIb shown in FIG. 9A are set to the shift register 71 corresponding to the nozzle rows A and B, respectively, and the print data SIc and SId are set to the shift register 71 corresponding to the nozzle rows C and D, respectively.

Meanwhile, when the print data depending on the switching flag=0 is created, in step S17, the print data is set to the nozzle rows depending on the switching flag That is, the print data SIa and SIb shown in FIG. 9B are set to the shift register 71 corresponding to the nozzle rows A and B, respectively, and the print data SIc and SId are set to the shift register 71 corresponding to the nozzle rows C and D, respectively.

Moreover, in the next step S18, the printing is executed. That is, the ejection of one dot (one time) is performed in the main scanning direction X based on the set print data, and is performed by the same number as the dot number of one pass, thereby performing the printing of one pass. At this time, since the printing is performed by the use of the nozzle rows A to D, the printing of resolution of 360 dpi is performed on the paper by the operation of one pass.

When the printing of one pass is finished, in the next step S19, the paper feeding of the normal pitch is performed. That is, since the printing of resolution of 360 dpi is performed, for example, the paper feeding of an amount corresponding to the length of the one nozzle row (180 nozzles) is performed.

In step S20, it is determined whether or not the printing of one page is finished. If the printing of one page is not finished, the process returns to step S13. Moreover, the printing proceeds by alternately repeating the printing operation of one pass by the processes of steps S13 to 15 and S18, and the paper feeding operation at the normal pitch by the step S19.

Moreover, when it is determined that the printing of one page in step S20, the process proceeds to step S21, and the switching flag is changed from "1" to "0".

In the next step S22, it is determined whether or not the printing is finished, if a page to be printed still remains, the paper feeding of the next page is performed in step S23. In this manner, when the paper of the next page is fed, the printing of the next page is started.

In step S13 at the time of printing of the next page (a second page), since it is determined that the switching flag=0, the process proceeds to step S16, the print data depending on the switching flag "0" is created. That is, the print data SIa, SIb, SIc, and SId shown in FIG. 9B are created. Moreover, in step S17, the print data is set to the nozzle row depending on the switching flag "0". That is, the print data SIa and SIb shown in FIG. 9B are set to the shift register 71 corresponding to the nozzle rows A and B, respectively, and the print data SIc and SId are set to the shift register 71 corresponding to the nozzle rows C and D, respectively.

In the next step S18, the printing is performed. That is, the ejection of one dot (one time) is performed in the main scanning direction X based on the set print data, and is performed by the same number as the dot number of one pass, thereby performing the printing of one pass. At this time, since the printing is performed by the use of the nozzle rows A to D, the printing of resolution of 360 dpi is performed on the paper by the operation of one pass.

When the printing of one pass is finished, in the next step S19, the paper feeding of the normal pitch is performed. When the printing of one page is not finished (a denial determination in S20), the process returns to step S13.

Moreover, the printing proceeds by alternately repeating the printing operation of one pass by the processes of steps S13 to 15 and S18 and the paper feeding operation at the normal pitch by step S19. In the printing of the second page, the use nozzle groups in the nozzle rows C and D are switched. That is, in the printing of the first page, the nozzle row C performs the printing using the first nozzle group NC1 as the use nozzle group and the nozzle row D performs the printing using the second nozzle group ND2 as the use nozzle group (FIG. 7A). Meanwhile, in the printing of the second page, the nozzle row C performs the printing using the second nozzle group NC2 as the use nozzle group and the nozzle row D performs the printing using the first nozzle group ND1 as the use nozzle group (FIG. 7B). For this reason, the usage is not biased to particular partial (half) nozzles in the nozzle rows C and D, and all of the nozzles are used. As a consequence, for example, an occurrence rate of nozzle clogging of the nozzle row C and D is reduced, and the life of the ejection driving element 38 is extended.

Moreover, the printing of the second page is finished, and when it is determined that the printing of one page is finished in step S20, the process proceeds to step S21, and the switching flag is changed from "0" to "1".

Moreover, in the next step S22, when it is determined that a page to be printed still remains, the paper feeding of the next page is performed in step S23. In this manner, when the paper of the next page is fed, the printing of the next page is started.

Hereinafter, similarly, the respective processes of steps S13 to S23 are repeated to print of the paper of each page. For example, when printing odd pages, as shown in FIG. 9A, the nozzle row C uses the first nozzle group NC1 as the use nozzle row and the nozzle row D uses the second nozzle group ND2 as the use nozzle row, respectively, thereby performing the printing. Meanwhile, when printing even pages, as shown in FIG. 9B, the nozzle row C uses the second nozzle group NC2 as the use nozzle group and the nozzle row D uses the first nozzle group ND1 as the use nozzle group, respectively, thereby performing the printing. Moreover, the printing of all the pages is finished, and when it is determined that the printing is finished in step S22, the routine is finished.

Next, the printing of the slow printing mode performed when ink is depleted in one of the ink cartridges 21 and 22 will be described based on steps S25 to S33.

When the slow printing mode is set, in the next step S25, the print data of one row is created. That is, the print data SIm (the recording data) shown in FIG. 10A is created. In addition, in the embodiment, the process of step S25 corresponds to the data creation step of creating the common recording data (the print data SIm in the present example) in M (two in the present example) first nozzle rows (the nozzle rows C and D in the present example). Furthermore, an example of the data generating unit is constituted by the main control portion 61 that performs the process of the step S25.

In the next step S26, it is determined whether or not ink is depleted in the first ink cartridge 21. If ink is depleted in the first ink cartridge 21, the process proceeds to step S27, and the print data is set to the nozzle row D. That is, the print data SIm shown in FIG. 10B is set to the shift register 71 corresponding to the nozzle row D.

Meanwhile, if ink is not depleted in the first ink cartridge 21 (that is, ink is depleted in the second ink cartridge 22), the process proceeds to step S28, and the print data is set to the nozzle row C. That is, the print data SIm shown in FIG. 10C is set to the shift register 71 corresponding to the nozzle row C.

Moreover, in the next step S29, the printing is executed. That is, the ejection of one dot (one time) in the main scanning direction is performed based on the set print data, and the operation is performed by the same number as the dot number of one pass, thereby performing the printing of one pass. At this time, since the printing is performed only using one nozzle row of only the nozzle row C or the nozzle row D, the printing of resolution of 120 dpi is performed on the paper by the operation of one pass. In addition, in the embodiment, the control step is constituted by steps S27 to S29. Furthermore, the control unit is constituted by the job control portion 62 and the engine control portion 63 that perform the processes of steps S27 to S29.

When the printing of one pass is finished, since the paper feeding of the paper of ⅓ pitch is performed in the next step S30. That is, since the printing of the resolution of 120 dpi is performed, the paper feeding of an amount corresponding to the pitch corresponding to ⅓ of the nozzle pitch ΔP is performed. Herein, in the case of the configuration in which the printing is performed at the printing resolution of the pixel pitch of 1/J of the nozzle pitch ΔP using the J nozzle rows, in the slow printing mode, the paper feeding is performed at the pitch of 1/J of the nozzle pitch ΔP.

In step S31, it is determined whether or not the printing of one page is finished. If the printing of one page is not finished, the process returns to step S25. Moreover, whenever the printing operation of one pass by the processes of steps S25 to S29 and the paper feeding operation at ⅓ pitch of the nozzle pitch ΔP by the step S30 are alternately repeated three times, the printing of the resolution of 360 dpi is performed on the paper. Moreover, when the printing of the resolution of 360 dpi is performed on the paper (that is, whenever the paper feeding of three times is finished), the paper feeding of the one normal pitch (the pitch corresponding to the length of the one nozzle row) is performed. In this manner, the printing proceeds at the printing speed of about ⅓ of the normal printing mode. Moreover, the printing of one page is finished, and when it is determined that the printing of one page is finished in step S31, the process proceeds to step S32. Then, it is determined whether or not the printing is finished, if a page to be printed still remains, the paper feeding of the next page is performed in step S33. In this manner, when the paper of the next piece of paper is fed, the process returns to step S25, and the processes of S25 to S32 are repeated to perform the printing of each page. Moreover, when the printing of all the pages is finished (an affirmation determination in S32), the routine is finished.

In this manner, according to the embodiment, during the slow printing mode, the main control portion 61 may create the print data SIm of one nozzle row without discriminating the nozzle row C or the nozzle row D. Furthermore, since the print data SIm is common between the nozzle rows C and D, the job control portion 62 which receives the print data SIm from the main control portion 61 does not need the data confirmation process that checks whether or not the print data SIm corresponds to the use nozzle row. Moreover, in order for the engine control portion 63 which receives the print data SIm from the job control portion 62 to ascertain the ink cartridge in which the ink depletion is not detected, particularly, even if not performing a special process of selecting the nozzle rows of the data set place, the engine control portion 63 may set the print data SIm in the driving system (the shift register 71) only corresponding to the ink cartridge in which ink is not depleted of the nozzle rows C and D. For this reason, the processes in the main control portion 61, the job control portion 62, and the engine control portion 63 are simplified. When the processes of the respective portions 61 to 63 are simplified, it is also possible to share the program between different models.

As described above, in the embodiment, the effect described below can be obtained.

(1) In addition to the J (three in the present example) nozzle rows A to C required in the formation of a predetermined printing resolution (360 dpi in the present example), the nozzle row D for the ink depletion time in which the nozzle positions of the sub scanning direction Y are identical to each other. Moreover, a configuration may be adopted in which a plurality of lines (J+M−1) (four in the present example) nozzle rows is connected to the ink cartridges 21 and 22, respectively, and when ink is depleted, the printing is performed by the use of the one other than the ink cartridge in which ink is depleted among the M ink cartridges 21 and 22. Thus, even when the ink cartridge used in the printing when ink is depleted is any of the M ink cartridges 21 and 22, since the nozzle rows having the same nozzle position are used, the main control portion 61 does not need to discriminate the use nozzle rows and create the print data SIm. That is, in the slow printing mode when ink is depleted, the print data SIm of one nozzle row capable of commonly being used in the nozzle rows C and D is simply created.

(2) One nozzle row D having the same nozzle positions in the sub scanning direction as one nozzle row (for example, the nozzle row C) may be added to the nozzle rows of the minimum number (three) required in the printing at a predetermined printing resolution in the normal printing mode. In this case, when one nozzle row is not used during normal printing mode, the nozzle clogging is a concern. In the embodiment, since the printing of one nozzle row is performed by the use of each half of two nozzle rows C and D, the non-use nozzle row not used in the normal printing mode can be eliminated, whereby the occurrence frequency of the nozzle clogging can be reduced.

(3) Furthermore, when using each half of the nozzle rows C and D, since a configuration may be adopted in which the position of the half nozzle (the nozzle group) to be used is not fixed, and the position of the nozzle to be used is switched for each prescribed interval, it is possible to perform the printing by the use of all of the nozzles of the nozzle rows C and D in the normal printing mode. Thus, it is possible to effectively reduce the occurrence frequency of the nozzle clogging.

(4) Particularly, in the embodiment, since the interval of one printing page is adopted as the prescribed interval, and whenever the printing of one page is finished, the use nozzle group is switched between the nozzle rows C and D, if the printing of two pages or more is performed, all of the nozzles of the nozzle rows C and D can be used once. For example, if the nozzle is left for a long period of time in the unused state, ink thickened in the inner portion of the unused nozzle is soon solidified, whereby it is feared that the nozzles cannot be restored to a usable state even when using a maintenance device. However, in the embodiment, even in the normal printing mode, since all of the nozzles of the nozzle rows C and D are used in the intermittent printing for each one page, it is possible to avoid the severe clogging of the nozzles as above. As a consequence, even if the clogging is generated, the clogging can be dissolved.

(5) Furthermore, since the use nozzles are switched for each one printing page between the nozzle rows C and D, it is possible to suppress a decline in printing image quality (the printing quality) due to a change in use nozzle during printing of one page.

(6) In the slow printing mode, since the paper is fed (transported) at a feeding pitch 1/J of the nozzle pitch ΔP, it is possible to perform the printing at a predetermined printing resolution (for example, 360 dpi) simply by using only one row of the nozzle row C or the nozzle row D.

In addition, the embodiment mentioned above can also be changed to the forms as below.

A method of dividing the use nozzle between the M nozzle rows C and D is not limited to the configuration in which the nozzles are divided by the same ratio. For example, the nozzles may be divided by the combination of 60% and 40% of all the nozzle rows, the combination of 70% and 30%, the combination of 80% and 20%, and the combination of 90% and 10%.

Furthermore, the invention is not limited to the configuration in which the use nozzles are divided between the M nozzle rows C and D. For example, the use nozzles may be one nozzle row, and the use nozzles may alternately be switched between the M nozzle rows C and D by one row at a time.

The nozzle row D, in which all of the nozzles have the same position in the sub scanning direction as the nozzle row C among the three nozzle rows A to C capable of being printed at a predetermined printing resolution (360 dpi in the present example), may be used as the additional or use nozzle row. Meanwhile, for example, a nozzle row having the same nozzle position in the sub scanning direction as the nozzle row B may be added, and a nozzle row having the same nozzle position in the sub scanning direction as the nozzle row A may be added. In this case, the addition of the nozzle row includes a reconstruction of the recording head added with the nozzle rows, a diversion of the color printing recording head to the black printing, and an addition of the remaining nozzle rows as the use nozzle rows.

The J second nozzle row capable of printing at a predetermined printing resolution may be the only common nozzle row (the first nozzle row). That is, a configuration may be adopted in which only two nozzle rows of the first nozzle row and the second nozzle row are provided in the recording head. In this case, the predetermined printing resolution is the resolution having the same pixel pitch as the nozzle pitch ΔP. Of course, the printing may be performed at the printing resolution of the pixel pitch 1/U of the nozzle pitch, for example, by setting the paper feeding pitch to 1/U (U is a natural number equal to or greater than 2) of the nozzle pitch ΔP.

The number of the J second nozzle row capable of printing at a predetermined printing resolution may be two, and may be four or more. Similar to the case of three, even in the case of two and four or more, the first nozzle row may be added in which all of the nozzles have the same position in the sub scanning direction as the positions of each nozzle of one second nozzle row thereof.

An example of liquid accommodated in the ink cartridge, which is an example of the liquid receptor, is not limited to the same color, and may be an approximate color. For example, a combination of black, charcoal gray, yellow, light yellow, and dark yellow, a combination of cyan, light cyan, and dark cyan, and a combination of magenta, light magenta, and dark magenta may be adopted. For example, it is preferable for the colors to be approximate with each other when being printed by any ink color such that there is no problem.

In the embodiment mentioned above, a configuration was described in which black and white or gray scale printing is performed by the use of black ink, the invention may be applied to a printing apparatus capable of performing the color printing. For example, the four nozzle rows arranged in the pattern shown in FIG. 2 are set to one ink color, and the four nozzle rows of such an arrangement pattern are provided by the same number as the ink color required for the color printing. According to the configuration, it is possible to continue the printing in the slow printing mode even when ink is depleted in one of color ink cartridges provided in plurality.

The respective functional portions of the control portion 42 in the controller in FIG. 4 were realized in software by the CPU that executes the program, but the functional portions may be realized in hardware or may be realized by the cooperation of the software and the hardware.

The recording apparatus may be a lateral type printer, without being limited to the serial printer.

In the embodiment mentioned above, the ink jet type printer 11 is adopted as the recording apparatus, but a liquid ejection device may be adopted which ejects or discharges another liquid other than ink. Furthermore, the invention can be used in various liquid ejection devices that include a liquid ejection head or the like which discharge a minute amount of liquid droplets. In this case, the liquid droplets refer to a liquid state discharged from the liquid ejection device, and also includes matter leaving traces in a gradual shape, a tear shape and a filiform. Furthermore, liquid mentioned herein may be a material that can be ejected by the liquid ejection device. For example, matter of a condition when a substance is a liquid phase may be used, and liquid having high or low viscosity, sol, gel water, other inorganic solvent, organic solvent, solution, liquid phase resin, a flow-like body such as a liquid phase metal (metallic melt), liquid as one state of substance, as well as matter in which particles of the functional material formed of a solid body such as pigment or metallic particle are dissolved, dispersed, or mixed in the solvent or the like are included. Furthermore, as a typical example of liquid, ink, liquid crystal or the like as described in the embodiment mentioned above are included. Herein, ink includes various liquid compositions such as general water-based ink, oil-based ink, gel ink, and hot-melt ink. As a specific example of the liquid ejection device, for example, it is possible to adopt a liquid crystal display, an EL (electroluminescence) display, a plane emission display, a liquid ejection device which ejects liquid containing the material such as an electrode material or a color material used in the manufacturing of the color filter or the like in the form of the dispersion or the dissolution. In addition, the liquid ejection device may be a liquid ejection device that ejects a living body organic matter used in manufacturing the bio chip, a liquid ejection device that is used as a precision pipette and ejects liquid becoming a sample, a printing device, a micro dispenser or the like. In addition, it may be possible to adopt a liquid ejection device that ejects lubricant oil to a precision machine such as a watch or a camera by a pinpoint, a liquid ejection device that ejects transparent resin liquid such as ultraviolet curing resin for forming a micro hemispherical lens (an optical lens) used in an optical communication element or the like onto a substrate, and a liquid ejection device that ejects etching liquid such as acid or alkali for etching the substrate or the like. Moreover, the invention can be applied to any one kind of liquid ejection device among them.

The technical idea understood from the embodiment and the modified example mentioned above will be described below.

(1) According to an aspect of the invention, there is provided a recording apparatus that includes a recording unit which is supplied with liquid from a first liquid receptor (21) and a second liquid receptor (22) each receiving the same kind of liquid and can be moved in a main scanning direction, and a transport unit that transports a recording medium in a sub scanning direction, wherein the recording apparatus includes the recording unit in which a first nozzle row (C) and a second nozzle row (D), which are provided so that the positions of the nozzles of the different rows are identical to each other in the sub scanning direction, are disposed so as to be shifted in the position in the main scanning direction; a first flow path (35) which supplies liquid from the first liquid receptors to the first nozzle row; a second flow path (36) which supplies liquid from the second liquid receptors to the second nozzle row; a determination unit that determines whether or not liquid is depleted in one of the first and second liquid receptors; a first data generating unit which creates first recording data capable of being recorded using all of the first and second nozzle rows when it is determined that liquid is not depleted in any one of the first and second liquid receptors and creates second recording data corresponding to one row common to the first and second nozzle rows when it is determined that liquid is depleted; and a control unit that sends the first recording data to the driving system of the used nozzle row, performs the recording by the use of all of the first and second nozzle rows, when liquid is depleted in the first liquid receptor, sends the second recording data to the driving system of the second nozzle row, and performs the recording by the use of the second nozzle row, and meanwhile, when liquid is depleted in the second liquid receptor, sends the second recording data to the driving system of the first nozzle row, and performs the recording by the use of the first nozzle row.

(2) In the recording apparatus described in technical idea (1), the recording unit is provided with a plurality of nozzle rows in which the nozzles of the different rows are provided so as to be mutually shifted in the position in order to realize the required recording resolution, the first nozzle row is one nozzle row of the plurality of nozzle rows, the second nozzle row is a nozzle row that is provided separately from the plurality of nozzle rows so that the position in the sub scanning direction is identical to the first nozzle row, the first flow path is provided so as to supply liquid from the first liquid receptor to a partial nozzle row except for the first nozzle row among the plurality of nozzle rows and the first nozzle row, the second flow path is provided so as to supply liquid from the second liquid receptor to another partial nozzle row except for the first nozzle row among the plurality of nozzle rows and the second nozzle row, the first recording data created by the data generating unit is data content that performs the recording by the use of all of the plurality of nozzle rows, the first nozzle row and the second nozzle row, and the second recording data created by the data generating unit is a recording data of one row that performs the recording without using the plurality of nozzle rows, and is common to the first nozzle row and the second nozzle row.

What is claimed is:

1. A recording apparatus that includes a recording unit which is supplied with liquid from each of M liquid receptors (M is a natural number equal to or more than two) each receiving the same kind of liquid and can be moved in a main scanning direction, and a transport unit that transports a recording medium in a sub scanning direction, the recording apparatus comprising:

the recording unit in which M nozzle rows having the same position in the sub scanning direction are disposed so that the positions thereof are shifted in a main scanning direction;

a flow path which supplies liquid from the M liquid receptors to the M nozzle rows;

a determination unit that determines whether or not liquid is depleted in one of the M liquid receptors;

a data generating unit which generates first recording data capable of recording first single nozzle row data by the use of all of the M nozzle rows when it is determined that liquid is not depleted in any one of the M liquid receptors, and generates second recording data capable of recording second single nozzle row data capable of commonly being used in the M nozzle rows when it is determined that liquid is depleted; and a control unit that sends the first recording data to a driving system of the M nozzle rows to perform the recording of first single nozzle row data using all of the M nozzle rows when it is not determined that ink is depleted in any one of the M liquid receptors, and sends the second driving data to a recording system of the nozzle rows corresponding to the liquid receptor, in which liquid is not depleted, to perform the recording of the second single nozzle row data using the nozzle rows when it is determined that liquid is depleted.

2. The recording apparatus according to claim 1, wherein, the recording unit is provided with J (J is a natural number equal to or greater than M) second nozzle rows including a common nozzle row provided so that positions of the nozzles are shifted by 1/J of a nozzle pitch $\Delta P$ to the common nozzle row of the first nozzle rows in the sub scanning direction when the M nozzle rows are a first nozzle rows, the flow path is provided so as to connect the second nozzle rows of each set, in which the J second nozzle rows are divided by M set, to each of the M liquid receptors, the data generating unit generates the first recording data capable of being recorded by the use of all of the nozzles of (J−1) second nozzle rows except for the common nozzle row, and the data generating unit generates the second recording data in which the (J−1) second nozzle rows are not used in the recording.

3. The recording apparatus according to claim 2, wherein, when it is not determined that liquid is depleted, the control unit performs the recording of the first single nozzle row data in total by the use of all of the M first nozzle rows by one main scanning of the recording unit.

4. The recording apparatus according to claim 3, wherein, when it is not determined that liquid is depleted, the control unit performs the recording by the use of each 1/M row of the M first nozzle rows.

5. The recording apparatus according to claim 3, wherein, when it is not determined that liquid is depleted, the control unit switches the used nozzles between the M first nozzle rows for each prescribed interval.

6. The recording apparatus according to claim 5, wherein the prescribed interval is an interval of one recording page.

7. The recording apparatus according to claim 2, wherein, when it is determined that liquid is depleted and the recording is performed by the use of the first nozzle row connected to the liquid receptor in which liquid is not depleted among the M first nozzle rows, the control unit controls the transport unit so as to transport the recording medium at a pitch of 1/J of the nozzle pitch ΔP.

8. A recording method of a recording apparatus that includes a recording unit which is supplied with liquid from each of M (M is a natural number equal to or greater than two) liquid receptors each receiving the same kinds of liquid and can be moved in a main scanning direction, and a transport unit that transports a recording medium in a sub scanning direction, wherein the recording apparatus includes the recording unit in which M nozzle rows having the same position in the sub scanning direction are disposed so that the positions thereof are shifted in a main scanning direction, and a flow path which supplies liquid from the M liquid receptors to the M nozzle rows, the method comprising:

determining whether or not liquid is depleted in one of the M liquid receptors;

generating first recording data capable of recording first single nozzle row data by the use of all of the M nozzle rows when it is not determined that liquid is depleted in any one of the M liquid receptors, and generating second recording data capable of recording second single nozzle row data capable of commonly being used in the M nozzle rows when it is determined that liquid is depleted; and controlling so as to send the first recording data to a driving system of the M nozzle rows to perform the recording of one nozzle row by the use of all of the M nozzle rows when it is not determined that liquid is depleted in any one of the M liquid receptors, and controlling so as to send the second recording data to a driving system of the nozzle rows corresponding to the liquid receptor, in which liquid is not depleted, to perform the recording of the second single nozzle row data by the use of the nozzle row, when it is determined that liquid is depleted.

* * * * *